United States Patent [19]

Nishimura

[11] 3,994,114

[45] Nov. 30, 1976

[54] PACKING PROCESS AND APPARATUS FOR STACKING LOADS

[76] Inventor: Matsuo Nishimura, No. 13-7, 4-chome, Kita, Omori, Tokyo, Japan

[22] Filed: June 19, 1975

[21] Appl. No.: 588,315

[30] Foreign Application Priority Data

Feb. 5, 1975 Japan ..... 50-15033

[52] U.S. Cl. ..... 53/26; 53/30 S; 53/33; 53/162; 53/229; 53/373

[51] Int. Cl.[2] ..... B65B 11/50; B65B 35/50; B65B 51/10; B65B 53/02

[58] Field of Search ..... 53/26, 159, 30 S, 32, 53/33, 162, 164, 182, 184, 229, 245, 373, 198 R

[56] References Cited

UNITED STATES PATENTS

| | | | |
|---|---|---|---|
| 3,385,028 | 5/1968 | Pierce | 53/373 |
| 3,432,988 | 3/1969 | Minten | 53/198 R |
| 3,643,396 | 2/1972 | Togashi et al. | 53/182 X |
| 3,788,462 | 1/1974 | Meincer | 53/30 S X |
| 3,903,673 | 9/1975 | Grasvoll | 53/162 |

*Primary Examiner*—Travis S. McGehee
*Assistant Examiner*—Horace M. Culver
*Attorney, Agent, or Firm*—Kleinberg, Morganstern, Scholnick & Mann

[57] ABSTRACT

A process and apparatus for packing a stack of loads with synthetic resin films each possessing heat contractility. A plurality of loads are stacked on a pair of synthetic resin films placed in crossed relationship on an elevating table. The elevating table is movable downward from its upper extreme position so that the synthetic resin films are continuously supplied to cover side peripheries of the loads. Adjacent rib portions formed by side edges of the synthetic resin films covering the side peripheries of the loads are joined during downward movement of the elevating table. Upper opposing portions of each of the synthetic resin films are bent toward each other and joined together on the upper surface of the stacked loads on the elevating table. The synthetic resin films covering the loads are heated so that the films shrink.

10 Claims, 11 Drawing Figures

PACKING PROCESS AND APPARATUS FOR STACKING LOADS

This invention relates in general to a process and apparatus for packing a stack of loads without using pallets and, more particularly, to a process and apparatus for packing a stack of loads in a tightly and hermatically sealed relationship without causing disordering of the loads.

In prior art, it has been a common practice to pack a stack of loads in a tightly sealed condition with a synthetic resin film by placing the loads on a pallet and packing the piled loads only at the side and upper walls thereof while leaving the pallet under the loads during packing operation. Since, in this prior art method, the bottom wall of the loads is not packed, it is difficult to completely prevent moisture, dusts, water etc. from entering the packed stack of loads. Another drawback encountered in the prior art method resides in that since the packed stack of loads are transferred with the pallet, a relatively larger spacing is required for the transfer of the stack of loads and problems exist in transferring the pallet back to its original position.

It is therefore an object of the present invention to provide a process and apparatus for packing a stack of loads in a completely sealed condition.

It is another object of the present invention to provide a process and apparatus for packing a stack of loads without using a pallet.

It is another object of the present invention to provide a process and apparatus for packing a stack of loads in a simplified manner.

These and other objects, features, and advantages of the present invention will become more apparent from the following description when taken in conjunction with the accompanying drawings, in which.

Figure 1:
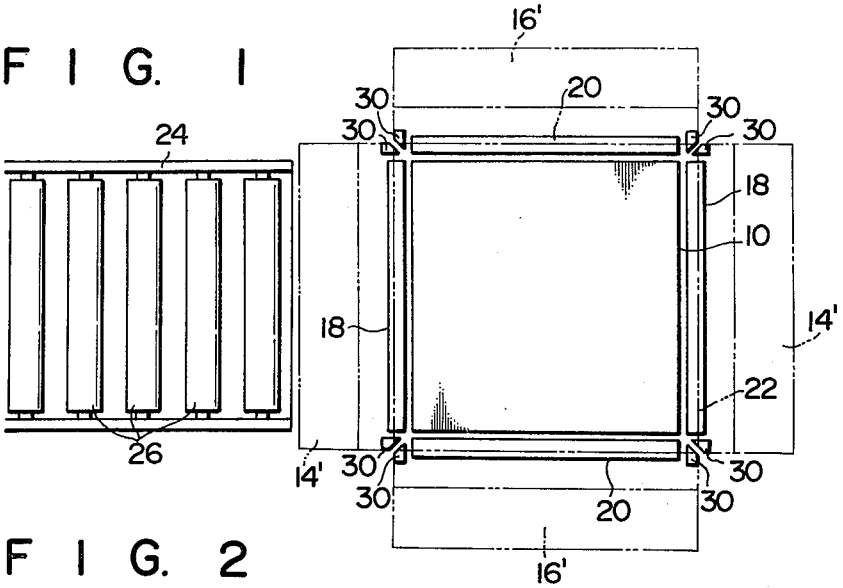
FIG. 1 is a schematic plan view of an apparatus performing a first step of a process of the present invention.
Figure 2:
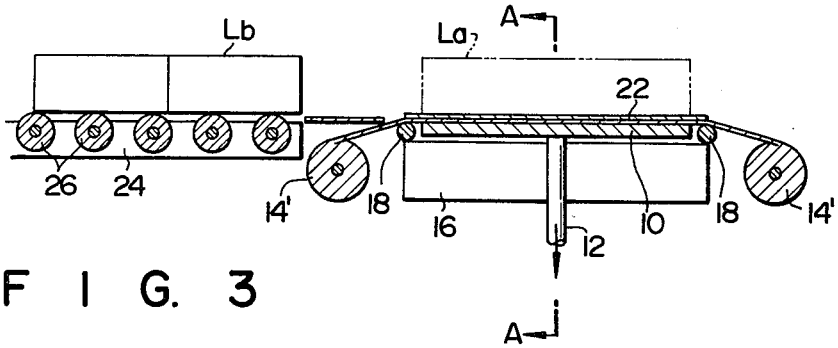
FIG. 2 is a schematic side view of the apparatus shown in FIG. 1.
Figure 3:
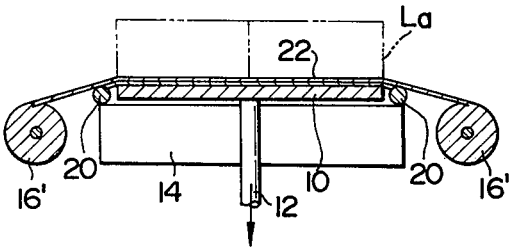
FIG. 3 is a sectional view taken along a line A—A of FIG. 2.

Referring now to FIGS. 1 to 3 of the drawings, there is schematically shown an apparatus for carrying out the process of the present invention. As shown, the apparatus is comprised of an elevating table 10 in the form of a rectangular shape which is raised and lowered by a shifting rod 12, which may be vertically moved by any suitable operating mechanism (not shown). The elevating table 10 is initially placed at its upper extreme position as shown in FIGS. 2 and 3. A pair of synthetic resin films 14 and 16 or sheets each possessing heat contractility and having a width slightly larger than that of the elevating table 10 are located in crossed relationship on the elevating table 10. One of the synthetic resin films is fed from a pair of rolls 14' positioned in parallel to side faces of the elevating table 10 and the other film is fed from another pair of rolls 16' also positioned in parallel to the other side faces of the elevating table 10. The synthetic resin films 14 and 16 are supported by first and second pairs of supporting rollers 18 and 20, respectively, each of which is rotatably mounted in parallel to each of the side faces of the elevating table 10.

Figure 4:
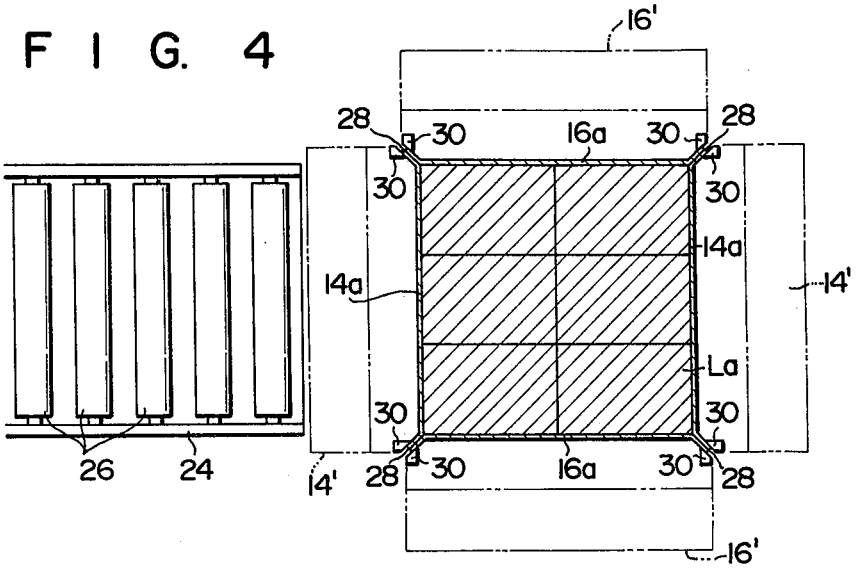
FIG. 4 is a schematic plan view partly in cross section of the apparatus performing a second step of the process.
Figure 5:
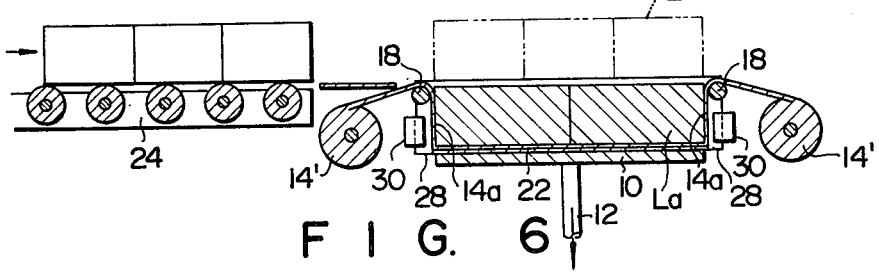
FIG. 5 is a schematic side view of the apparatus shown in FIG. 4.

Indicated as 24 is a carrier which is provided with a plurality of feeding rollers 26 having their upper surfaces slightly higher than the upper surface of the elevating table 10 so that a load L*a* is readily fed or supplied to a crossed portion 22 formed by the pair of films on the elevating table 10 as shown in FIGS. 2 and 3. After a load L*a* has been supplied to the crossed film portion 22 provided on the elevating table 10, the elevating table 10 is lowered by the shifting rod 12 by an amount corresponding to the height of the load L*a*. During this movement, each of the films is fed from the rolls toward the peripheries of the load L*a* as shown in FIGS. 4 and 5 and sticks thereto. Adjacent rib portions are formed by side edges of upwardly extending portions 14*a* and 16*a* of the films and joined with each other by heating means 30 provided below the supporting rollers 18 and 20.

Figure 6:
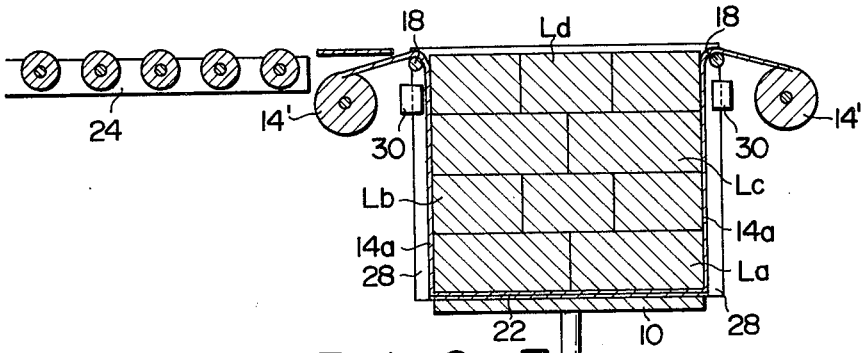
FIG. 6 is a schematic side view of the apparatus performing a third step of the process.
Figure 7:
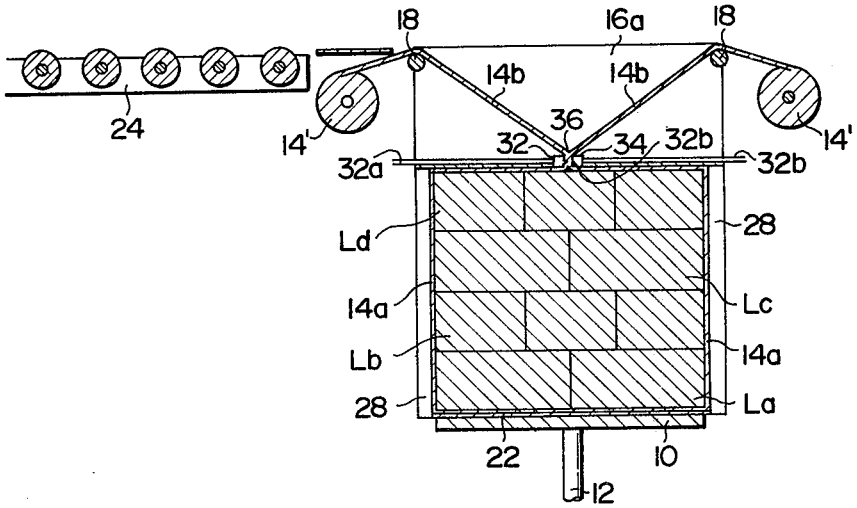
FIG. 7 is a schematic side view of the apparatus performing a fourth step of the process.

Similarly, other loads L*b*, L*c* and L*d* are supplied by the carrier 24 and stacked on the load L*a* in order as shown in FIG. 6. It should be noted that during this stacking operation the elevating table 10 is moved downward and, at the same time, the adjacent rib portions 28 of the films are continuously joined with each other by the heating means 30. Thereafter, the elevating table 10 is further lowered to a position shown in FIG. 7. A first pair of heating means in the form of sealing bars 32 and 34 are arranged to be horizontally movable toward each other by movable members 32*a* and 34*a*, respectively, for bending the upwardly extending portions 14*a* of the film to cover the upper surface of the load L*d*. The sealing bars 32 and 34 are then heated to join the upwardly extending portions 14*a* as at 36. Since, in this instance, the sealing bar 32 is formed with a cutting edge 32*b*, the joined portion of the upwardly extending portions 14*a* of the film 14 is cut at a suitable position such as the central portion of upper surface of the load L*d*. Remaining portion 14*b* of the film 14 is supported by the supporting rollers 18 by rotating the rolls 14' in the reverse direction for subsequent packing operation.

Figure 8:
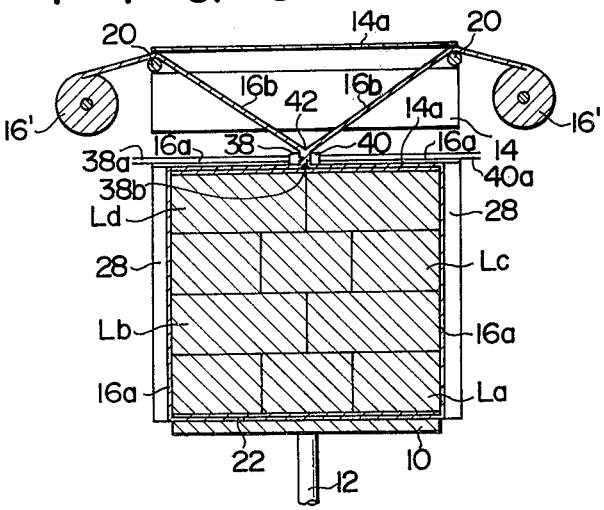
FIG. 8 is a schematic side view of the apparatus performing a fifth step of the process.

Likewise, a second pair of heating means in the form of sealing bars 38 and 40 are also arranged to be horizontally movable toward each other by movable members 38*a* and 40*a*, respectively, for bending the upwardly extending portions 16*a* of the film 16. The sealing bars 38 and 40 are heated to join the upwardly extending portions 16*a*. Then, the joined portion of the film 16 is cut at a suitable position on the upper surface of the load L*d* by a cutting edge 38*b* formed on the sealing bar 38 as at 42 as shown in FIG. 8. Subsequently, remaining portion 16*b* of the film 16 is supported by the supporting rollers 20 by rotating the rolls 16′ in the reverse direction. Thus, the films 14 and 16 are maintained in crossed condition for the subsequent packing operation.

It will thus be noted that the stack of loads L*a*, L*b*, L*c* and L*d* is completely packed by the crossed portion 22 of the films covering the bottom surface, the vertically extending films 14*a* and 16*a* covering the side walls and horizontally extending films 14*a* and 16*a* covering the upper surface of the stack.

Figure 9:
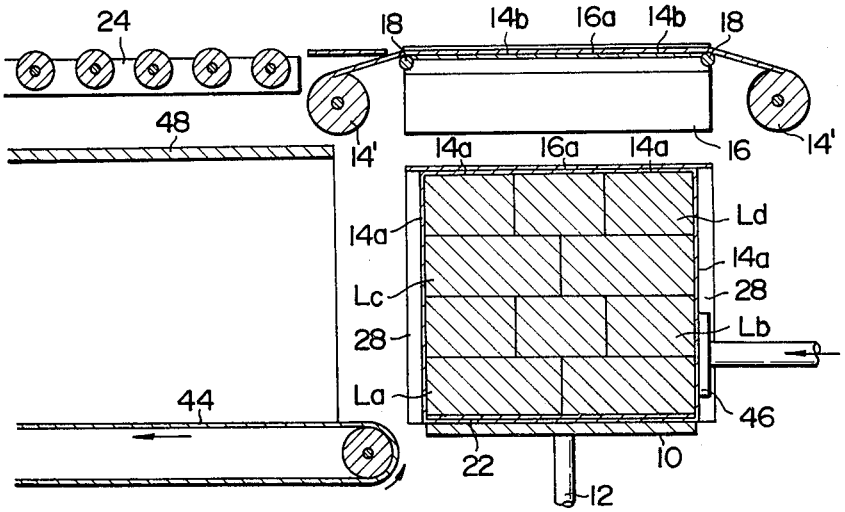
FIG. 9 is a schematic side view of the apparatus performing a sixth step of the process.
Figure 10:
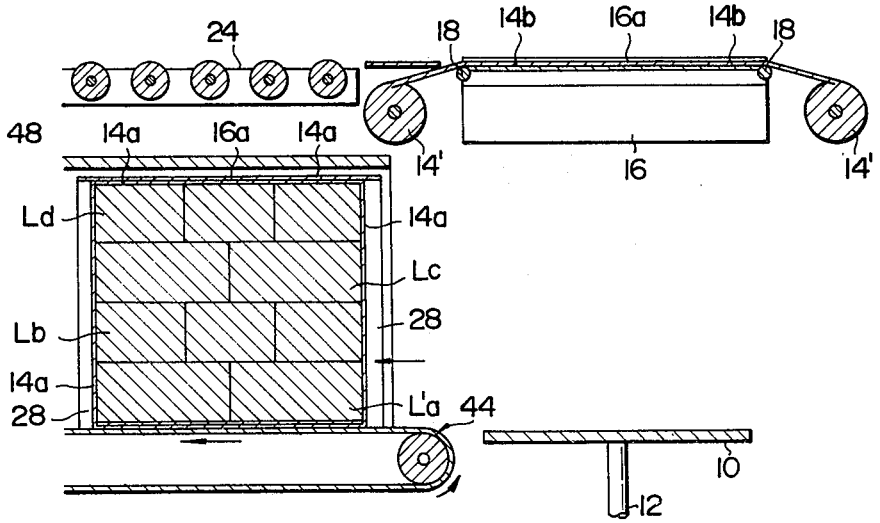
FIG. 10 is a schematic side view of the apparatus performing a seventh step of the process.
Figure 11:
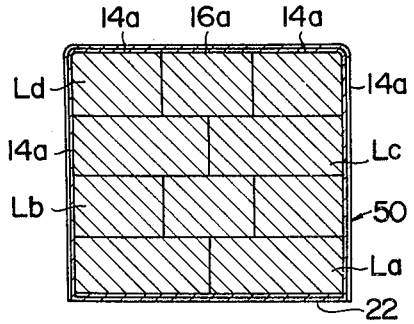
FIG. 11 is a sectional view of a stack of loads packed in accordance with the process of the present invention.

The stack of loads L*a*, L*b*, L*c* and L*d* thus packed is then transferred onto a conveyor belt 44 by a member 46 which is horizontally moved leftward as shown in FIG. 9. The stack of loads on the conveyor belt 44 is passed through heating means such as a heated tunnel 48 as shown in FIG. 10 to heat the films packing the stack of loads L*a*, L*b*, L*c* and L*d* so that the films are caused to shrink with the heat and tightly and hermatically stick onto the peripheries of the loads L*a*, L*b*, L*c* and L*d* as shown in FIG. 11.

It will now be appreciated from the foregoing description that in accordance with the present invention a stack of loads is completely packed without using a pallet and, therefore, each step of the process is simplified whereby the process of the present invention is highly adaptable to large-volume operations.

What is claimed is:

1. A packing process for a stack of loads comprising the steps of:

a. positioning a vertically movable rectangular elevating table at its upper extreme position;

b. laying a pair of synthetic resin films each having the width slightly larger than that of the elevating table and possessing heat contractility in crossed relationship on an upper surface of the elevating table;

c. stacking a plurality of loads on a crossed portion of the synthetic resin films one by one while lowering the elevating table from the upper extreme position thereof by an amount corresponding to the height of each of the loads, whereby the synthetic resin films are continuously fed to cover side peripheries of the loads;

d. joining adjacent rib portions formed by side edges of the synthetic resin films covering the side peripheries of the loads during downward movement of the elevating table;

e. bending upwardly extending portions of each of synthetic resin films toward each other to cover an upper surface of the stacked loads;

f. joining the upwardly extending portions of the respective synthetic resin films one after the other such that the joined portions cross each other on the upper surface of the stacked loads; and g. heating the synthetic resin films packing the stack of loads thereby causing shrinkage of the synthetic resin films.

2. A packing process according to claim 1, further comprising the step of cutting the upwardly extending portions of each of the synthetic resin films after step (*f*).

3. A packing process according to claim 1, in which the synthetic resin films are fed from rolls provided in parallel to side faces of the elevating table.

4. A packing process according to claim 3, in which the synthetic resin films are supported by supporting rollers rotatably mounted inwardly of the respective rolls.

5. A packing process according to claim 4, in which the rib portions formed by side edges of the synthetic resin films are joined by heating means located below the supporting rollers.

6. A packing process according to claim 1, in which the upwardly extending portions of each of the synthetic resin films are joined by first and second pairs of heating means which are horizontally movable in crossed relationship over the upper surface of the stacked loads.

7. A packing apparatus for a stack of loads comprising, in combination:

a. a rectangular elevating table initially positioned at its upper extreme position and vertically movable downward from its upper extreme position;

b. supporting means for supporting a pair of synthetic resin films in crossed relationship on said elevating table;

c. means for supplying a load onto the pair of synthetic resin films on said elevating table;

d. means for joining adjacent longitudinally extending rib portions formed by side edges of said synthetic resin films covering the side peripheries of the loads;

e. means for joining upwardly extending portions of each of the synthetic resin films; and f. means for heating the synthetic resin films to shrink the same.

8. A packing apparatus according to claim 7, further comprising cutting means for cutting the upwardly extending portions of each of the synthetic resin films.

9. A packing apparatus according to claim 7, in which supporting means includes supporting rollers provided in parallel to side faces of said elevating table.

10. A packing apparatus according to claim 7, in which said joining means (*e*) includes first and second pairs of sealing bars which are horizontally movable toward each other.

* * * * *